United States Patent [19]

Ueda

[11] 3,973,339

[45] Aug. 10, 1976

[54] FLAP TYPE INDICATING DEVICE

[75] Inventor: Minoru Ueda, Kouriyama, Japan

[73] Assignee: Copal Company Limited, Tokyo, Japan

[22] Filed: Dec. 20, 1973

[21] Appl. No.: 426,660

[30] Foreign Application Priority Data

Dec. 25, 1972 Japan ..... 47-3699[U]

[52] U.S. Cl. ..... 40/73.4; 58/125 C

[51] Int. Cl.[2] ..... G09F 11/06

[58] Field of Search ..... 40/35, 52 R, 72, 73.4, 40/78.07, 102, 104 RA; 58/2, 4 R, 4 A, 5, 6 R, 125 C, 126 E, 127 R; 340/338

[56] References Cited

UNITED STATES PATENTS

| | | | |
|---|---|---|---|
| 3,830,053 | 8/1974 | Koide et al. | 58/125 C |

FOREIGN PATENTS OR APPLICATIONS

| | | | |
|---|---|---|---|
| 731,879 | 4/1966 | Canada | 58/125 C |
| 673,517 | 1/1930 | France | 58/125 C |

*Primary Examiner*—Richard C. Pinkham
*Assistant Examiner*—Vance Y. Hum
*Attorney, Agent, or Firm*—Oblon, Fisher, Spivak, McClelland & Maier

[57] ABSTRACT

A flap-type indicating device includes two, co-axially mounted indicator assemblies and a resilient synchronizing element interposed therebetween for insuring the synchronous changing of the indicator elements upon the two assemblies at a predetermined time. A cam member, integrally formed upon the rotatable drum of one of the assemblies, is provided for axially biasing the synchronizing element toward the other one of the assemblies so as to prevent the changing of the indicator device prior to the predetermined time, and a lug member is operatively associated with one of the flaps of the first assembly for continuing the biasing action of the synchronizing element towards the other indicator assembly after the cam member has been released from the synchronizing element and until the occurrence of the predetermined time.

6 Claims, 7 Drawing Figures

FLAP TYPE INDICATING DEVICE

BACKGROUND OF THE INVENTION

The present invention relates to a flap type indicating device and, more particularly, to a synchronizing mechanism for changing in synchronism with each other the indications in two series of indications in a flap type indicating device having a low speed rotative flap type indicating assembly adapted to exhibit a first series of indications upon one revolution thereof and a high speed rotative flap type indicating assembly adapted to exhibit a second series of indications upon one revolution thereof, the respective indication of said first series being determined to be switched successively to the next indication each time said second series of indication has been completed.

A prior art synchronizing mechanism in a flap type indicating device of the type as described above such as that embodied in a flap type digital clock which includes a plurality of hour drums so as to indicate successively the time in terms of hour by the respective flaps as the same are swung successively during one complete revolution of the hour drum by disengagement of the flap from a holding member adapted to temporarily arrest the respective flaps and a plurality of minute flaps swingably mounted in series along the periphery of a minute drum coaxially arranged with the hour drum so as to indicate successively the time in terms of minute by the respective flaps as the same are swung successively during one complete revolution of the minute drum by disengagement of the flap from a holding member adapted to temporarily arrest the respective flaps is determined to insure that the hour flap such as indicating 4 o'clock, for example, is positively swung so as to indicate the next indication, i.e., 5 o'clock, when the minute flap indicating 59 minute is swung so as to indicate the next indication of 00 minute so that false indication such as 4 o'clock 00 minute or 5 o'clock 59 minute is positively prevented after the time 4 o'clock 59 minute lapses.

In such a prior art synchronizing mechanism as described above, a lug is formed in each of the minute flaps indicating respectively from 45 minute to 59 minute, while a resilient synchronizing member is interposed between the hour flaps and the minute flaps so as to be actuated by the lug of the respective flaps to move into the path of movement of the hour flaps for temporarily arresting the hour flap then positioned to be swung for the next indication during the rotation of the hour drum, and the time the holding member for temporarily arresting the hour flap then positioned to be swung for the next indication is disengaged therefrom is set to be earlier than the time at which the minute flap indicating 59 minute is disengaged from the holding member temporarily arresting the same so as to complete one cycle of the series of minute indications, the synchronizing member being so configured that the lug of the minute flap indicating 45 minute actuates the synchronizing member during the rotation of the minute drum before the hour flap then positioned to be swung for the next indication is disengaged from the holding member therefor, so that the hour flap then positioned to be swung for the next indication is held at its indicating position until the minute flap indicating 59 minute is swung to switch to 00 minute and disengages the lug thereof from the synchronizing member to swing the hour flap for the next indication even though the holding member for hour flaps has been disengaged from the respective hour flap, thereby insuring the synchronized operation of the respective hour flap and the minute flap indicating 59 minute.

In this case, if the clock is designed to indicate 24 hours, the hour drum is rotated by one revolution in 24 hours, whereas the hour drum is rotated by one revolution, if the clock is designed to indicate 12 hours. At any rate, the rotative speed, i.e., the amount of revolution of the hour drum per hour is extremely low and, therefore, it is made very difficult to exactly set the time at which the respective hour flap is disengaged from the holding member therefor for the next indication in synchronism with the switching of minute indication from 59 minute to 00 minute, because very high machining accuracy of the parts and accurate assembly thereof are required so as to obtain the desired result. Thus, the lugs are formed in minute flaps indicating respectively 45 minute to 59 minute so as to cooperate with the synchronizing member for insuring the synchronized operation of the hour and minute flaps as described above.

In making the flaps, as is evident, press dies and punches for making the flaps having the lugs are very difficult to be manufactured in comparison with those for making the flaps without any lugs, while the lugs of the flaps are liable to be deformed or damaged during the manufacture and the assembly of the flaps, therefore, necessity of using large number of flaps having the lugs in the prior art has caused difficulties in the manufacture of flap type indicating devices.

SUMMARY OF THE INVENTION

The present invention aims at avoiding the disadvantages of the prior art flap type indicating devices as described above.

Therefore, the object of the present invention is to provide a novel and useful flap type indicating device which avoids the above described disadvantages and which is simple in construction and easy to manufacture at a low cost while high accuracy in performance is insured.

The above object is achieved in accordance with the present invention by the provision of a flap type indicating device including a low speed rotative indicating assembly having a plurality of flaps swingably mounted in series along the periphery of a first drum so that the flaps are successively swung as the drum is rotated by one revolution so as to exhibit a first series of indications successively by the respective flap, a high speed rotative indicating assembly coaxially arranged with the low speed rotative indicating assembly adjacent thereto and having a plurality of flaps swingably mounted in series along the periphery of a second drum so that the flaps are successively swung as the second drum is rotated by one revolution so as to exhibit a second series of indications successively by the respective flap, and coupling means coupling the high speed rotative indicating assembly with the low speed rotative indicating assembly so that the low speed rotative indicating assembly is actuated to provide the succeeding indication of the first series each time the high speed rotative indicating assembly completes one cycle of exhibition of the second series of indications, the coupling means including a resilient synchronizing member interposed between the low and high speed rotative indicating assemblies and normally held apart from the path of movement of the flaps of the low speed rotative indicating assembly but being movable, upon actuation thereof, into the path of movement of the flaps so as to arrest the respective flaps, the resilient synchronizing member being adapted to be released upon completion of the cycle of exhibition of the second series of indications by the high speed rotative indicating assembly thereby permitting the successive one of the first series of indications to be exhibited each time upon completion of exhibition of the second series of indications in synchronism therewith, the device being characterized by a cam member interposed between the resilient synchronizing member and the high speed rotative indicating assembly and rotatable in synchronism with the drum of the high speed rotative indicating assembly so as to actuate the resilient synchronizing member for arresting the respective flaps of the low speed rotative indicating assembly, and a lug formed in the last one of the flaps of the high speed rotative indicating assembly for indicating the last of the second series of indications, the lug being so arranged that it actuates the resilient synchronizing member to arrest the respective flap of the low speed rotative indicating assembly when the last flap comes into the position exhibiting the indication born thereon, the angular orientation of the cam member being so determined that it actuates the resilient synchronizing member to arrest the respective flaps of the low speed rotative indicating assembly by the rotation of the drum of the high speed rotative indicating assembly during a period beginning at a predetermined time prior to the completion of one cycle of the second series of indications of the high speed rotative indicating assembly and ending at a time after the lug of the last flap of the high speed rotative indicating assembly comes into the position to actuate the resilient synchronizing member but prior to the completion of one cycle of the second series of indications of the high speed rotative indicating assembly.

The cam member may be formed integral with the second drum of the high speed rotative indicating assembly in the arcuate form positioned concentrically of the axis of rotation of the drum and having an inclined leading edge for facilitating the engagement thereof with the resilient synchronizing member.

By the device of the present invention as described above, it suffices to provide only one flap having a lug thereby permitting the troublesome working and assembling of the flaps inherent to the prior art to be widely avoided and the manufacturing cost to be reduced while high accuracy in operation is positively achieved.

DETAILED DESCRIPTION OF THE PREFERRED EMBODIMENT

Figure 1:
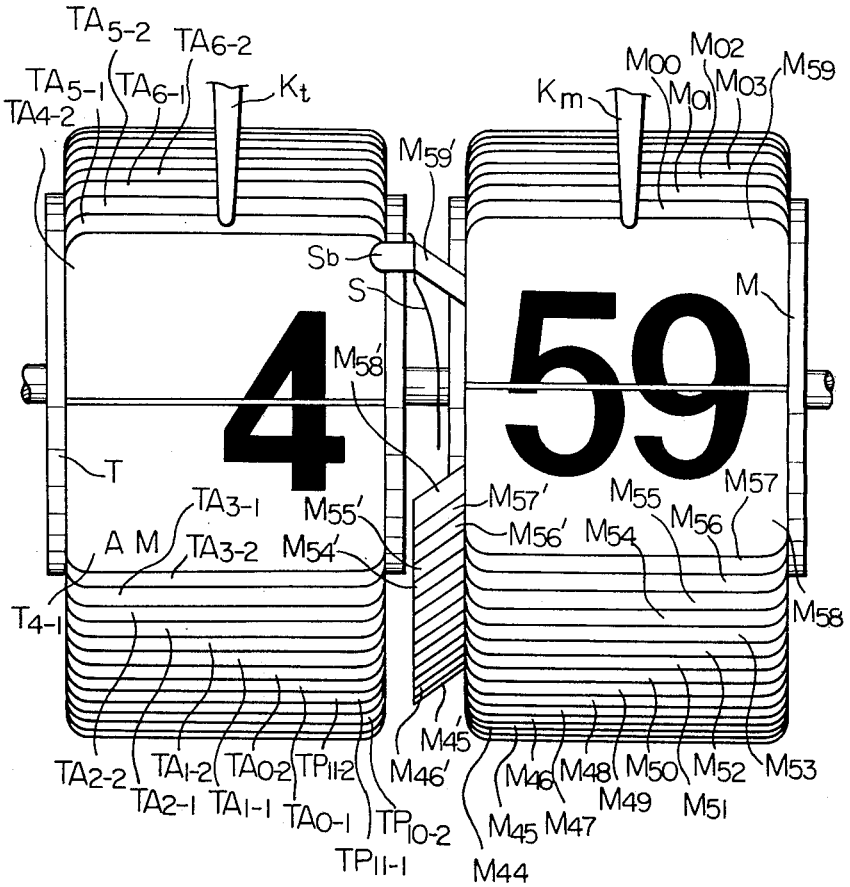
FIG. 1 is a frontview showing the main parts of a prior art flap type digital clock.

Referring to FIG. 1 showing a prior art flap type digital clock, a plurality of hour flaps $TA_{0-1}$, $TA_{0-2}$, $TA_{1-1}$, $TA_{1-2}$, . . . $TP_{11-1}$, $TP_{11-2}$ are swingably mounted in series along the periphery of hour drum T so that an hour indicating assembly (low speed rotative indicating assembly) is formed, and a minute indicating assembly (high speed rotative indicating assembly) is formed by a plurality of minute flaps $M_{00}$, $M_{01}$, . . . $M_{58}$, $M_{59}$ swingably mounted in series along the periphery of minute drum M. The respective hour flaps $TA_{0-1}$, $TA_{0-2}$ . . . $TP_{11-1}$, $TP_{11-2}$ and the respective minute flaps $M_{00}$, $M_{01}$ . . . $M_{58}$, $M_{59}$ are successively disengaged from a holding member Kt and a holding member Km, respectively, as the drum T and the drum M rotate in timed relationship with each other so that the respective flap is swung downwardly so as to indicate the time such as 4 o'clock 59 minute by the hour and the minute flaps now exposed for the indication. Since the switching of the time indication is governed by the relative positions of the top edge of the flap and the tip of the holding member in each of the hour and the minute indicating assembly, it is extremely difficult to synchronize the switching of hour indication from 4 o'clock to 5 o'clock, for example as shown, with the switching of minute indication from 59 minute to 00 minute in order to avoid false indication such as 4 o'clock 00 minute or 5 o'clock 59 minute after 4 o'clock 59 minute lapses, thus requiring a synchronizing mechanism for avoiding the false indication of the time.

In the prior art synchronizing mechanism as shown in FIG. 1, lugs M45' – M59' are formed in the respective minute flaps M45 – M59 indicating respectively 45 minute – 59 minute, while a resilient synchronizing member S is interposed between the drum M and the drum T so that the bent portion Sb at the free end of the member S which is normally held apart from the path of movement of the hour flaps may be moved into the path of movement of the hour flaps when the resilient synchronizing member S is actuated. The synchronizing member S is actuated by the respective lugs M45' – M59' of the minute flaps M45 – M59 when they approach the positions to be arrested by the holding member Km during the rotation of the drum M so that the synchronizing member S arrests the hour flap now held by the holding member Kt and exposed for the indication during the time beginning at 45 minute and ending at 59 minute. The time at which the holding member Kt is disenaged from the now exposed hour flap is so determined that the hour flap is disengaged from the holding member Kt before the minute flap M59 indicating 59 minute is disengaged from the holding member Km to switch the minute indication to 00 minute but after the lug M45' of the minute flap M45 actuates the synchronizing member S so as to arrest the hour flap now exposed. Thus, the hour flap now exposed is held in its indicating position by the synchronizing member S until the minute flap M59 is disengaged from the holding member Km for switching the indication to 00 minute and the lub M59' of the minute flap M59 is disengaged from the synchronizing member S for releasing the synchronizing member S even though the holding member Kt is disengaged from the hour flap now exposed, thereby permitting the hour flap now exposed to be swung for the next indication in synchronism with the swinging of the minute flap M59 indicating 59 minute to switch to 00 minute.

In the above described synchronizing mechanism of the prior art, since a plurality of lugs of the minute flaps are required, the manufacture of such minute flaps having lugs are very difficult and expensive and such flaps are liable to be deformed or damaged during the manufacture and assembly thereof.

FIGS. 2 – 7 show an embodiment of the present invention which avoids the above described disadvantages of the prior art.

The general construction of the embodiment shown in FIGS. 2 – 7 is similar to that of the prior art shown in FIG. 1 except that lugs of the minute flaps M45 – M58 are dispensed with leaving only the lug M59′ of the last minute flap M59. Instead, an arcuate cam member C having an inclined leading edge Ca and a land Cb is integrally secured to the minute drum M and so configured as to actuate the synchronizing member S as the drum M rotates before the holding member Kt is disengaged from the hour flap now exposed for the time indication as in the case of the device shown in FIG. 1 but disengage from the synchronizing member S until the lug M59′ is disengaged therefrom.

Figure 2:
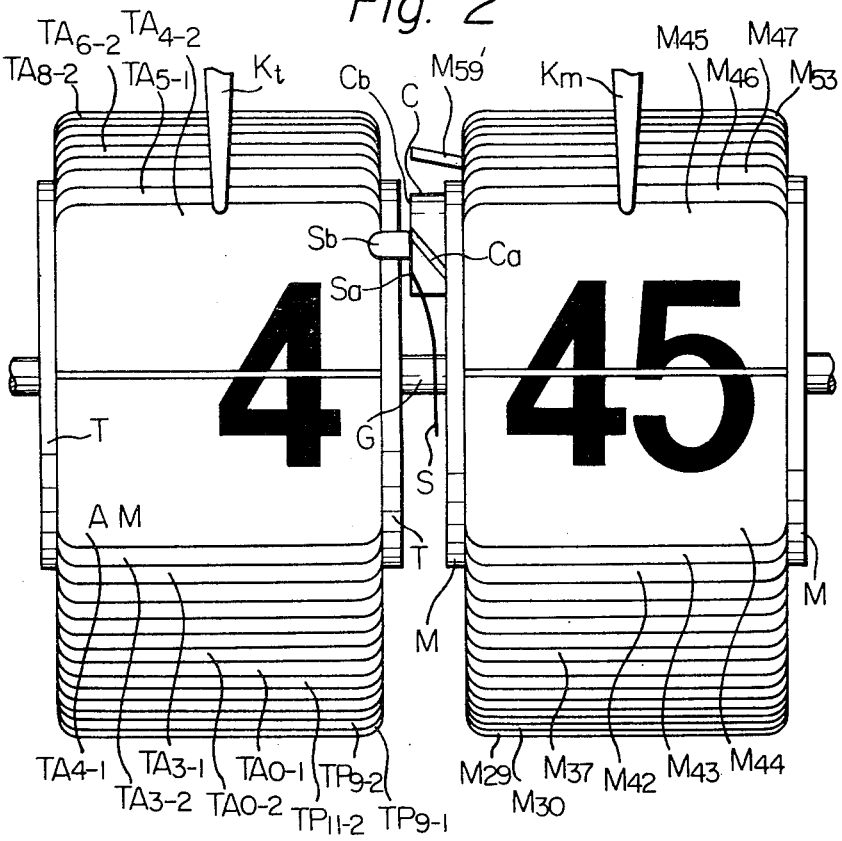
FIG. 2 is a frontview similar to FIG. 1 but showing the main parts of the flap type digital clock embodying the present invention in one of the rotational position of the minute drum.

As seen from FIG. 2, the hour and the minute indication is obtained by the pair of flaps exposed for the indication and the time indication is switched to the next indication each time the flap is disengaged from the holding member to be swung to expose the succeeding pair of flaps bearing thereon the next indication of the time.

Since the number of the minute flaps is 60, the number of the hour flaps is selected to be 48 so as to make the number of the hour flaps to approach the number of the minute flaps and the hour flaps are actuated every 30 minutes so that the successive two pairs of the hour flaps indicate the same hour indication during every 30 minutes.

The operation of the device of the present invention shown in FIGS. 2 – 7 is as follows.

Figure 3:
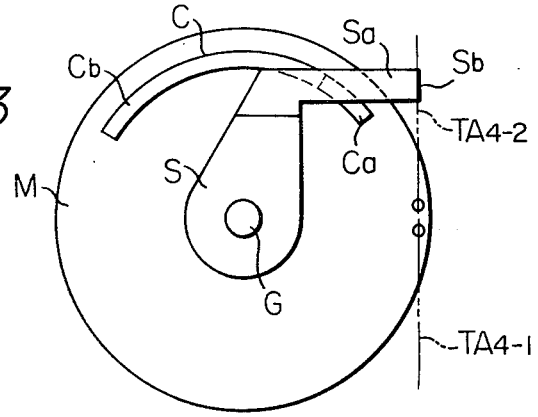
FIG. 3 is a schematic side view showing the relative position of the cam member and the synchronizing member shown in FIG. 2.

As shown in FIGS. 2 and 3, when the indication of the minute flaps approaches 45 minute, the synchronizing member S slides along the inclined edge Ca of the cam member C in contact therewith and rides on the land Cb thereof so that the bent portion Sb of the synchronizing member S moves into the path of movement of the hour flap now arrested by the holding member Kt for arresting the same even though the holding member Kt is disengaged from the hour flap.

Figure 4:
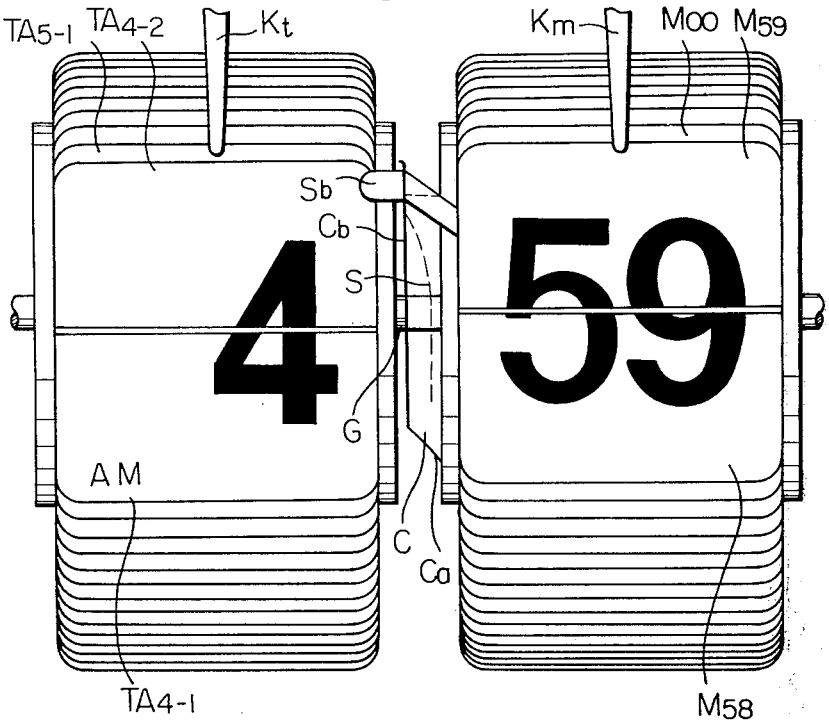
FIG. 4 is a front view similar to FIG. 2 but showing in another rotational position of the minute drum.
Figure 5:
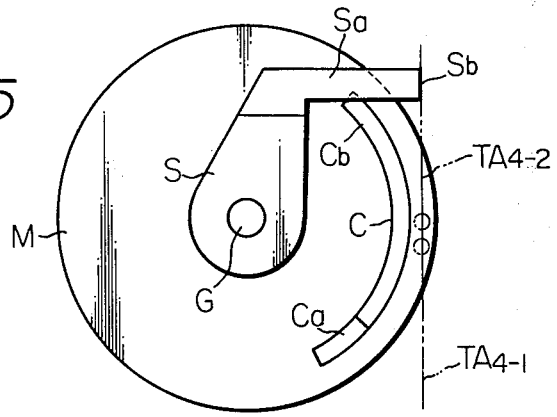
FIG. 5 is a schematic side view showing the relative positions of the cam member and the synchronizing member shown in FIG. 4.

Thereafter, as shown in FIGS. 4 and 5, when the indication of the minute flaps reaches 59 minutes, the lug M59′ of the hour flap M59 comes in contact with the portion Sa of the synchronizing member S so as to actuate the same.

Figure 6:
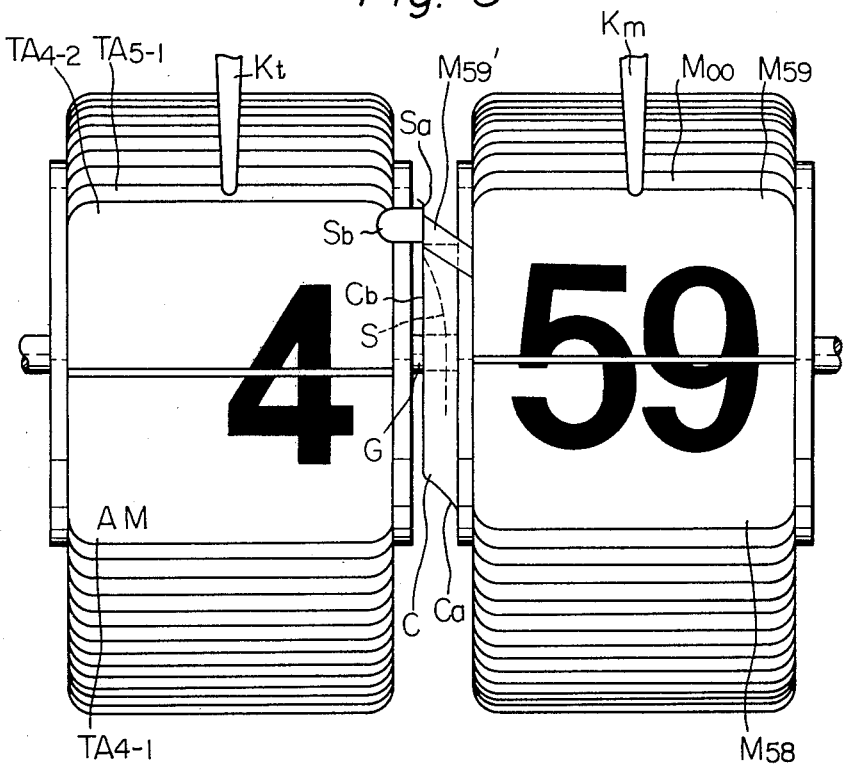
FIG. 6 is a front view similar to FIG. 2 but showing a still another rotational position of the minute drum.
Figure 7:
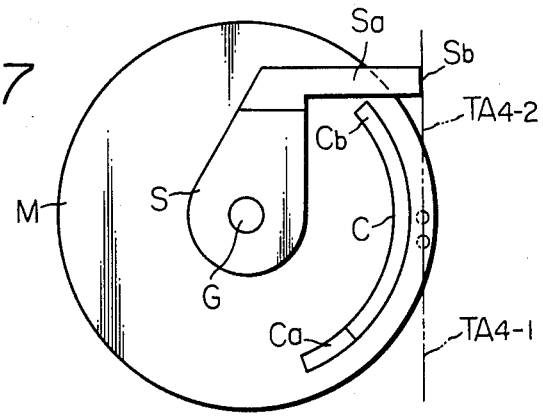
FIG. 7 is a schematic side view similar to FIG. 3 but showing the relative positions of the cam member and the synchronizing member shown in FIG. 6.

The land Cb of the cam member C is disengaged from the synchronizing member S during the time the indication of 59 minutes is continued by the minute flaps as shown in FIGS. 6 and 7, so that the synchronizing member S is held in its actuated position solely by the lug M59′ of the minute flap M59.

Thereafter, when the minute flap M59 is disengaged from the holding member Km and is swung downwardly for the next indication of 00 minute, the synchronizing member S is disengaged from the lug M59′ to release the member S thereby permitting the hour flap then arrested by the bent portion Sb of the member S to be disengaged from the bent portion Sb to swing the flap downwardly for the next indication in synchronism with the switching of the minute indication from 59 minute to 00 minute.

The above operation is repeated every hour when the minute indication reaches 45 minute.

The cam member C has been described as being fixedly secured to the drum M. However, the cam member C may be secured to a rotatable member which is rotated in coupled relationship to the drum M.

The present invention has been described as being embodied in a flap type digital clock. However, the present invention can be embodied in any indicating device such as "hour and date" or "hour and week day" indicating device and other device insofar as it includes a low speed rotative indicating assembly and a high speed rotative indicating assembly, wherein the low speed indicating assembly is actuated for the next indication each time the high speed indicating assembly completes the cycle of indication thereof.

I claim:

1. Flap type indicating device including a low speed rotative indicating assembly having a plurality of flaps swingably mounted in series along the periphery of a first drum and about a first axis so that said flaps are successively swung as said drum is rotated by one revolution so as to exhibit a first series of indications successively by the respective flap, a high speed rotative indicating assembly coaxially arranged with said low speed rotative indicating assembly adjacent thereto and having a plurality of flaps swingably mounted in series along the periphery of a second drum and about a second axis coaxial with said first axis so that said flaps are successively swung as said second drum is rotated by one revolution so as to exhibit a second series of indications successively by the respective flap, and coupling means coupling said high speed rotative indicating assembly with said low speed rotative indicating assembly so that said low speed rotative indicating assembly is actuated to provide the succeeding indication of said first series each time said high speed rotative indicating assembly completes one cycle of exhibition of said second series of indications, said coupling means including a resilient synchronizing member interposed between said low and high speed rotative indicating assemblies and normally held apart from the path of movement of said flaps of said low speed rotative indicating assembly but being axially movable, upon actuation thereof, into the path of movement of said flaps so as to arrest the respective flaps, said resilient synchronizing member being adapted to be released upon completion of the cycle of exhibition of said second series of indications by said high speed rotative indicating assembly thereby permitting the successive one of said first series of indications to be exhibited each time upon completion of exhibition of said second series of indications in synchronism therewith, wherein the improvement comprises an inclined cam member interposed between said resilient synchronizing member and said high speed rotative indicating assembly and rotatable in synchronism with said drum of said high speed rotative indicating assembly so as to axially bias said resilient synchronizing member toward said low speed rotative assembly for arresting the respective flaps of said low speed rotative indicating assembly, and a lug formed in the last one of said flaps of said high speed rotative indicating assembly for indicating the last of said second series of indications, said lug being so arranged that it also axially biases said resilient synchronizing member toward said low speed rotative assembly so as to continue the arresting process of the respective flap of said low speed rotative indicating assembly by synchronizing member when said last flap comes into the position exhibiting the indication born thereon, the angular orientation of said inclined cam member being so determined that it actuates said resilient synchronizing member to arrest the respective flaps of said low speed rotative indicating assembly by the rotation of said drum of said high speed rotative indicating assembly during a period beginning at a predetermined time prior to the completion of one cycle of said second series of indications of said high speed rotative indicating assembly and ending at a time after said lug of said last flap of said high speed rotative indicating assembly comes into the position to actuate said resilient synchronizing member but prior to the completion of one cycle of said second series of indications of said high speed rotative indicating assembly.

2. Flap type indicating device according to claim 1, wherein said inclined cam member is formed integral with said second drum of said high speed rotative indicating assembly in the arcuate form positioned concentrically of the axis of rotation of said drum and having an inclined leading edge for facilitating the engagement thereof with said resilient synchronizing member.

3. In a flap-type indicating device including a first, rotatably indicating assembly having a plurality of flaps serially and pivotably mounted thereon about a first axis, a second rotatable indicating assembly drivingly coupled with said first indicating assembly and having a plurality of flaps serially and pivotably mounted thereon about a second axis coaxial with said first axis, and synchronizing means interposed between said first and second assemblies for synchronizing the pivotable movement of said flaps of one of said assemblies with the pivotable movement of said flaps of the other one of said assemblies, the improvement comprising:

inclined cam means associated with said one of said assemblies for axially biasing said synchronizing means in a position toward said other one of said assemblies so as to prevent one of said flaps of said other one of said assemblies from pivoting prior to a predetermined time; and, lug means associated with one of said flaps of said one of said assemblies for engagingly retaining said synchronizing means in said biased position and continuing to maintain said biased position of said synchronizing means after said inclined cam means has been released from said synchronizing means, until said predetermined time, whereupon said predetermined time being reached, said lug means will be released from said synchronizing means which will in turn be released from said one of said flaps of said other one of said assemblies whereby said one of said flaps of said other one of said assemblies will be able to pivot in synchronization with said one of said flaps of said one of said assemblies.

4. In an indicating device as set forth in claim 3, wherein:

said indicating device is a digital clock;

said first indicating assembly is an hour indicating assembly wherein said flaps of said first assembly successively indicate the hour periods of the day;

said second indicating assembly is a minute indicating assembly wherein said flaps of said second assembly successively indicate the minute periods within said hour periods;

said lug means is associated with the flap indicating the last minute period within an hour period; and said predetermined time is the time at which a new hour commences.

5. In an indicating device as set forth in claim 4, wherein:

said inclined cam means is integrally formed upon said second indicating assembly and includes an arcuately extending portion, concentrically disposed relative to the rotatable axis of said second rotatable assembly, for biasing said synchronizing means toward said first assembly during a predetermined period prior to said predetermined time.

6. In an indicating device as set forth in claim 5, wherein:

said arcuate extent of said inclined cam means is such as to actuate said synchronizing means at approximately the three-quarter hour position of said hour period and to be released from said synchronizing means at approximately said last minute period of said hour period;

whereupon said lug means engages said synchronizing means.

* * * * *